United States Patent [19]

Totten

[11] Patent Number: 4,969,451

[45] **Date of Patent: * Nov. 13, 1990**

[54] RESPIRATORY STIMULATOR BED

[76] Inventor: Bertram F. Totten, 912 Yosemite La., El Dorado Hills, Calif. 95630

[ * ] Notice: The portion of the term of this patent subsequent to Feb. 13, 2007 has been disclaimed.

[21] Appl. No.: 41,419

[22] Filed: Apr. 23, 1987

[51] Int. Cl.[5] ..... A61H 1/00; A61H 31/00; A47D 9/02

[52] U.S. Cl. ..... 128/33; 5/108

[58] Field of Search ..... 5/108, 109; 128/33

[56] References Cited

U.S. PATENT DOCUMENTS

| | | | |
|---|---|---|---|
| 374,277 | 12/1887 | Smith | 5/108 |
| 910,888 | 1/1909 | Wilson et al. | 128/33 |
| 1,567,819 | 12/1925 | Stebbons | 128/33 |
| 1,784,082 | 12/1930 | Webb | 128/33 |
| 2,243,013 | 5/1941 | Morey et al. | 128/33 |
| 2,543,043 | 2/1951 | Miletello | 5/108 |
| 2,570,676 | 10/1951 | Henderson | 5/109 |
| 3,123,019 | 3/1964 | Blair | 5/109 |
| 3,529,311 | 9/1970 | Crawford | 5/109 |
| 3,849,812 | 11/1974 | Walsh | 5/108 |
| 3,874,011 | 4/1975 | Walsh et al. | 5/108 |
| 4,258,446 | 3/1981 | McAllister et al. | 5/109 |
| 4,277,857 | 7/1981 | Svehaug | 128/33 |
| 4,371,996 | 2/1983 | Naham | 5/108 |
| 4,412,533 | 11/1983 | Callahan | 128/33 |
| 4,419,777 | 12/1983 | Parker | 5/108 |

FOREIGN PATENT DOCUMENTS

| | | | |
|---|---|---|---|
| 1807785 | 2/1970 | Fed. Rep. of Germany | 128/33 |

*Primary Examiner*—Clifford D. Crowder
*Attorney, Agent, or Firm*—H. Walter Clum

[57] ABSTRACT

Unique crib or bed structure designed and constructed to combat and overcome sudden infant death syndrome by effecting an external and intermittent jarring stimulus to weak, slow and undeveloped body functions in accordance with the age and respiratory rate of an infant or other body reclining upon the crib or bed. In its preferred form in order to effect this intermittent jarring stimulus to a body reclining upon the crib or bed, an electronically controlled cam is positioned beneath the mattress supporting structure of the crib or bed intermittently when rotated to strike the underside of the mattress supporting structure, thereby jarring it in a manner effecting intermittent cycles of upward and downward motions of the mattress supporting structure and a mattress supported thereon, with a momentary pause or rest period between each cycle of cam rotation at which time the cam is completely out of contact with the mattress supporting structure.

4 Claims, 5 Drawing Sheets

RESPIRATORY STIMULATOR BED

BACKGROUND OF THE INVENTION

1. Field of the Invention

The present invention relates to bio-engineered beds but more particularly to such crib structures wherein its unique construction and best mode of operation is designed to stimulate the respiratory rate of infants while sleeping upon its mattress and thereby overcome the mysterious infant sudden death syndrome.

2. Description of the Prior Art

While the known prior art discloses crib structures for moving crib mattresses in a number of ways and directions, none has specifically dwelt with this infant death syndrome, and none discloses a construction and mode of operation which would be effective to overcome it, as has the present invention.

SUMMARY OF THE INVENTION

The primary object of the present invention is to provide a unique bio-engineered bed or crib structure which, in its best mode of operation is effective to overcome the mysterious infant death syndrome.

More specifically it is an object of this invention to provide such a crib structure which is effective to impart an external and jarring intermittent stimulus to weak, slow, and undeveloped body functions in accordance with the age and respiratory rate of an infant reclining upon the crib mattress.

Another and more specific object of the invention is to provide such a crib structure which is easy to operate and maintain and which is of simple design and of low cost in production.

According to the above, and other objects of this invention to be described hereinafter in greater detail, there is provided a novel bio-engineered bed or crib structure wherein a controlled frequent and intermittent slightly jolting up and down movement is applied to its mattress, thereby to impart an intermittent external stimulus to an infant or other body reclining upon its mattress consistent with the age and predetermined respiratory rate of the infant or other body.

BRIEF DESCRIPTION OF THE DRAWINGS

The foregoing and other objects and advantages of the invention and its best mode of operation will become apparent from the detailed description of the accompanying drawings, wherein.

DETAILED DESCRIPTION OF THE INVENTION

Figure 1:
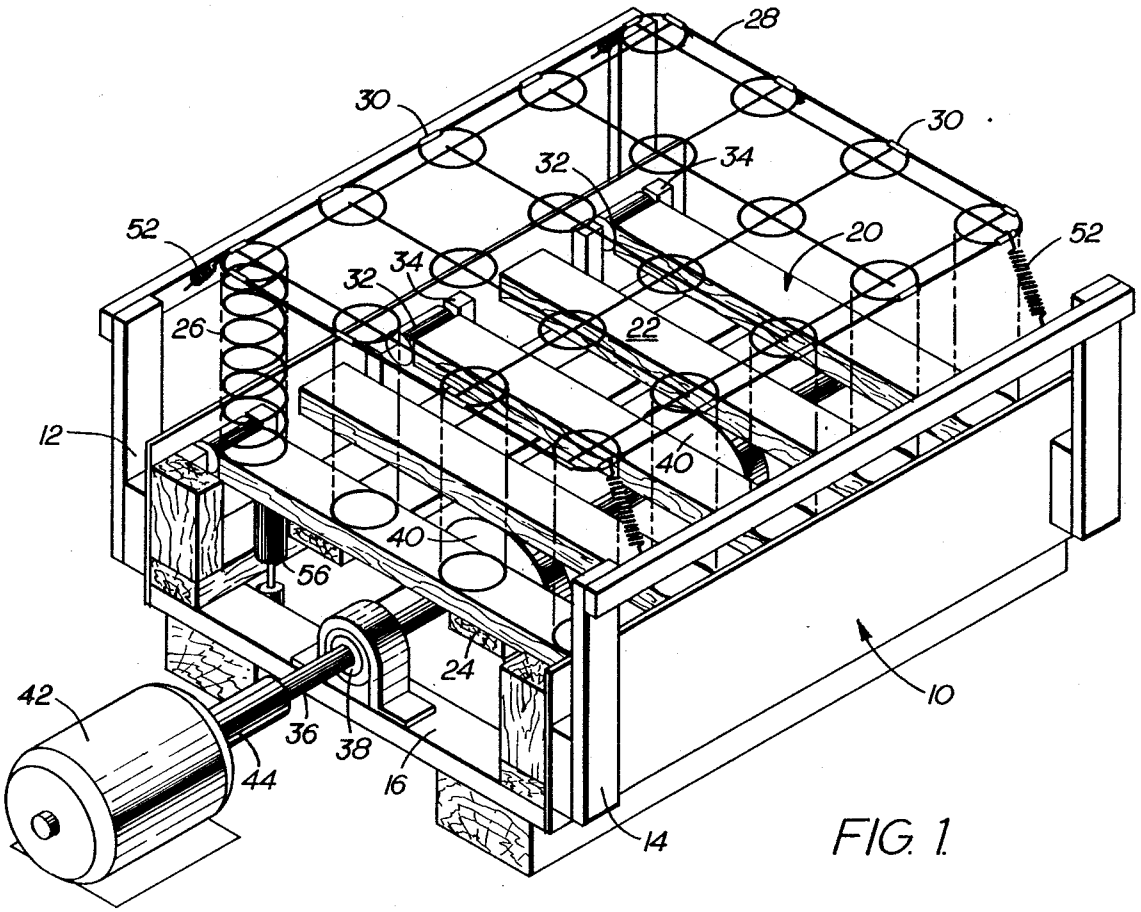
FIG. 1 is an isometric view of the preferred embodiment of the invention incorporated in a crib structure illustrated without the normal legs and guard walls.

Referring now to the drawings, and first to FIG. 1 thereof, it will be seen that the crib structure of this preferred embodiment of the invention includes a substantially U-shaped frame or chassis member 10 having opposed side wall assemblies 12 and 14 extending upwardly from its base member 16 and parallel to each other.

A mattress supporting structure 18 is supported within the frame member 10 and comprises a bed spring support platform 20 which, in this embodiment, comprises a plurality of bed slats 22 tied together into a unitary structure by tie bars 24 extending across the bottom of the slats and secured thereto by screws or other suitable means, not shown. It should be understood, however, that the bed slat platform could be replaced by a single panel member.

Figure 2:
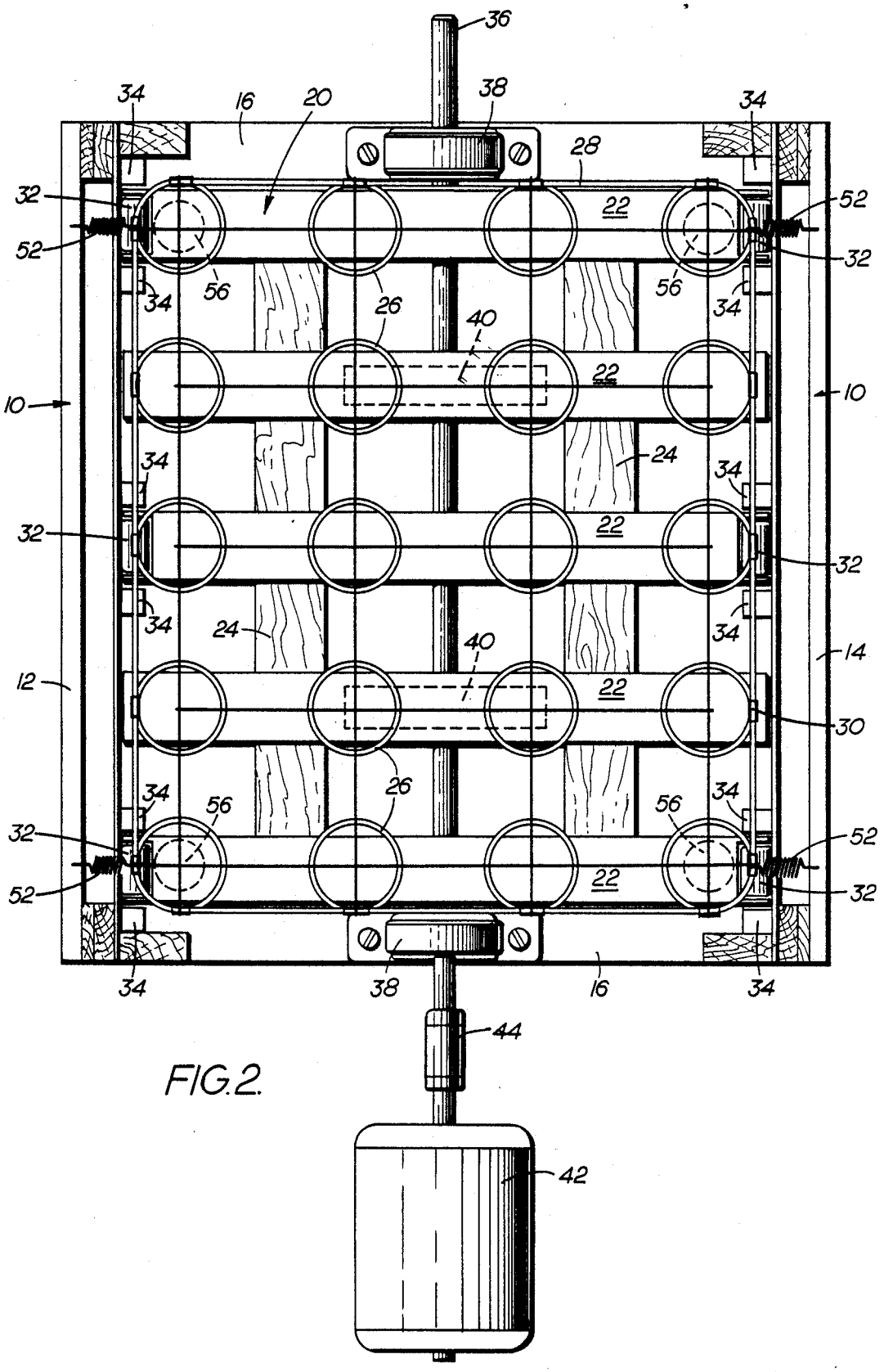
FIG. 2 is a top plan view thereof.

As illustrated, the bottoms of bed springs 26, here shown fragmentarily and diagrammatically, are secured to the platform 20 and extend upwardly to the mattress carrying member 28 and secured thereto by clamps 30. While, as shown in FIG. 1 and 2, there are four bed springs carried by each of the slats 22, it will be understood, however, that the number of springs shown is merely illustrative, as the number will vary according to the size of the whole crib structure.

Figure 3:
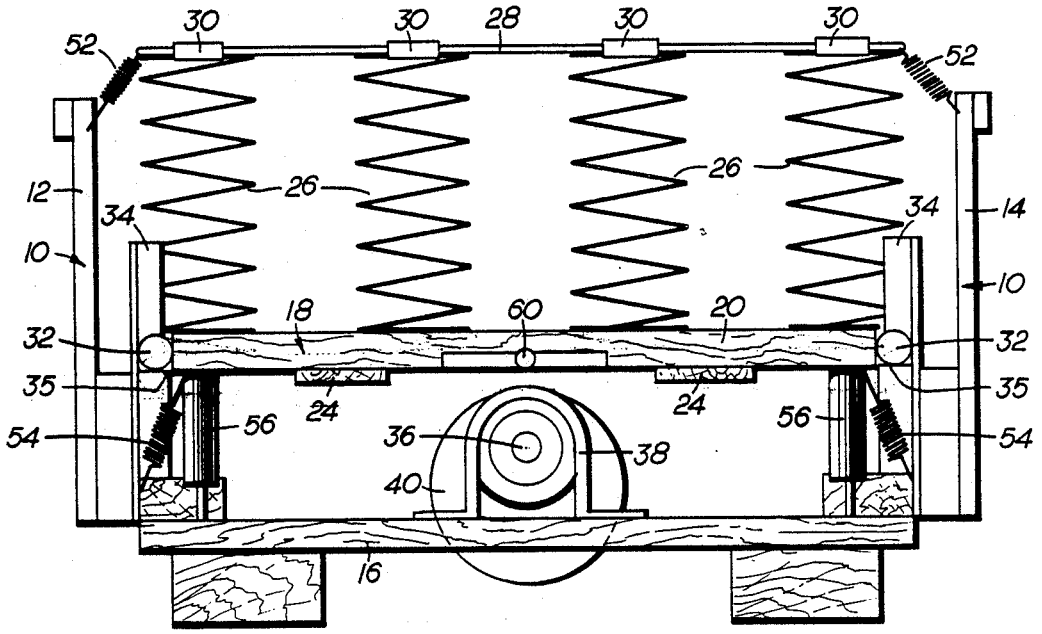
FIG. 3 is a front elevational view of FIG. 2 showing the "at rest" condition of the crib structure without a body upon its mattress supporting member.
Figure 5:
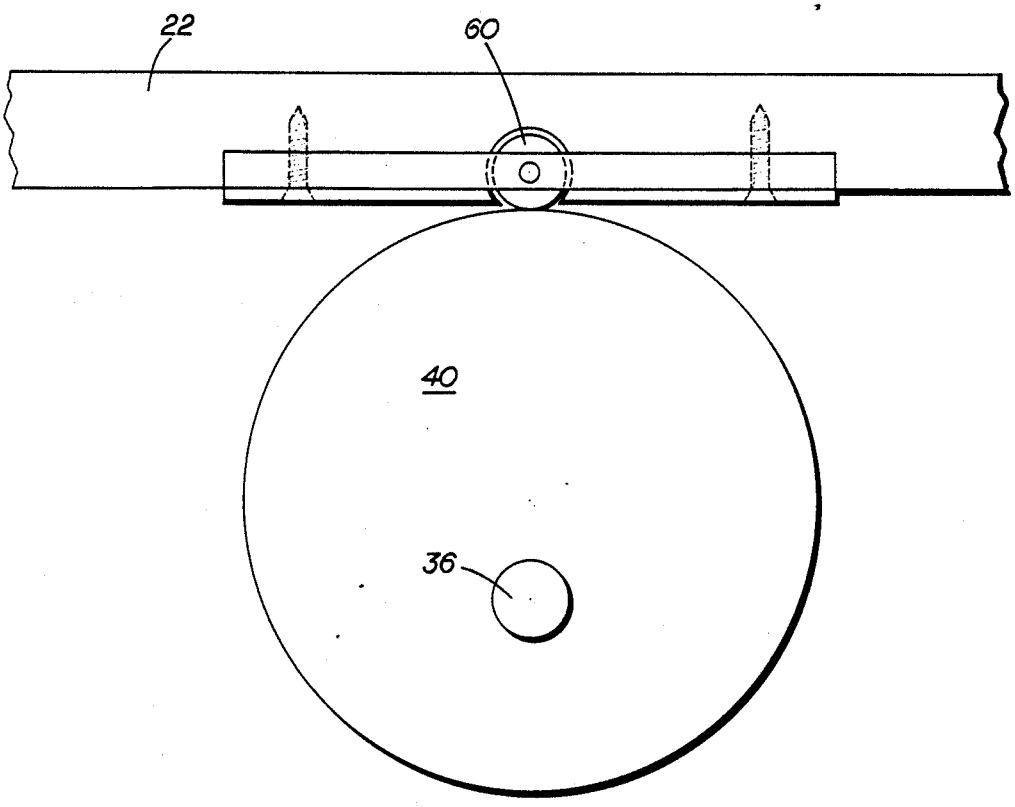
FIG. 5 is a fragmentary sectional view of a portion of the crib structure illustrated in an operative condition thereof.
Figure 6:
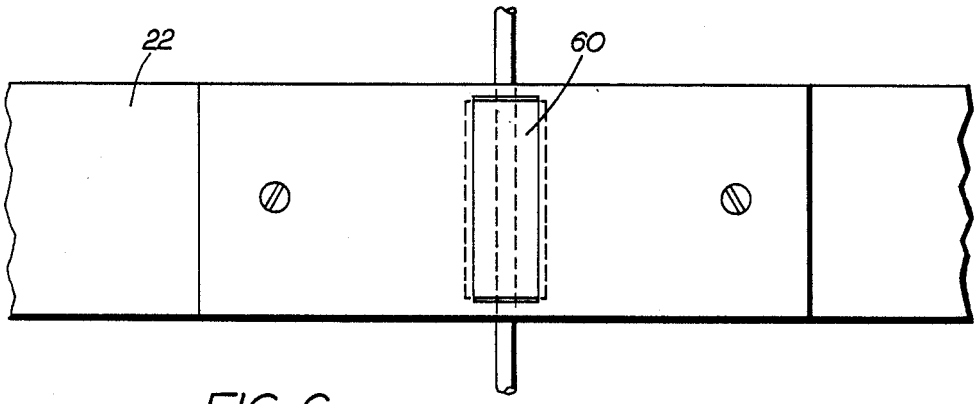
FIG. 6 is a bottom plan view of FIG. 5.

Platform 20 has rollers 32 secured at least to its four corners for engagement within guideways 34 formed on the inner surfaces of the side wall assemblies 12 and 14 thereby to control the up and down movements of the mattress supporting structure 18. In the "at rest" condition of the structure, as seen in FIG. 3, rollers 32 are shown resting upon the bottoms 35 of these guideways thus to hold the whole bed spring assembly 18 in a horizontal plane ready for its planned slightly jarring upward and downward movements.

Referring now to FIG. 1 through 4, it will be seen that a drive shaft 36 extends across the base member 16 of frame member 10 and journalled in roller bearings 38 mounted upon the opposite ends of base 16. Secured to shaft 36 beneath platform 20 are cam means, which in this embodiment of the invention, consists of a pair of cams 40, one each near opposite ends of platform 20.

Figure 7:
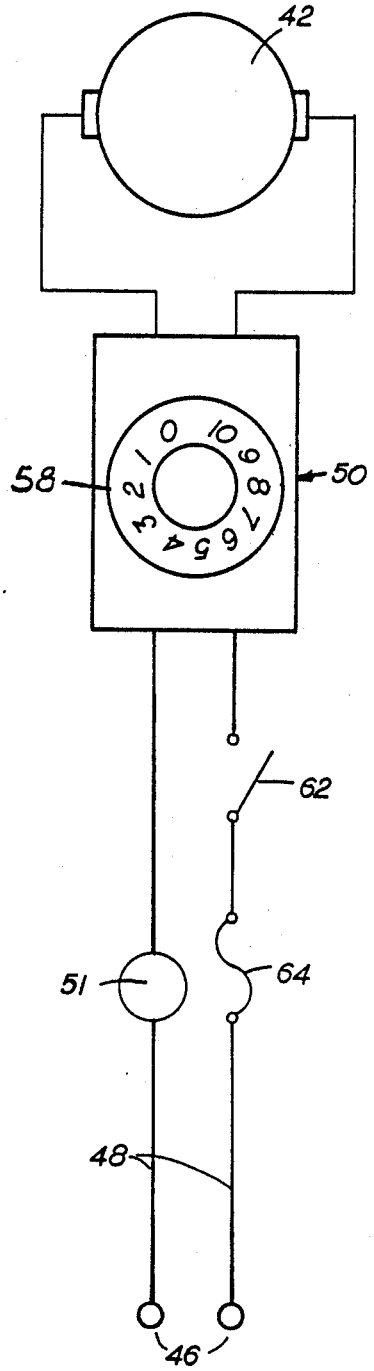
FIG. 7 is a controlling circut diagram.

Rotation of drive shaft 36 is by means of motor 42 through a flexible coupling 44. The motor is coupled to a suitable source of power 46, through wires 48 in which an electronic speed control 50 is coupled in series circuit. The motor and speed control preferably are of the type shown and described in "FORM 5S1965,09091, and FORM 5S1383,03758 respectively of the DAYTON ELECTRONIC MANUFACTURING COMPANY of Chicago, Ill. The series circuit for operating the motor at controlled speeds as illustrated in Dayton's FORM 5S1383 is reproduced here as FIG. 7. Included in the circuit is a signalling device 51 which may be visual, such as a lamp, or audible, such as a bell, for indicating the on/off condition of the power source whereby an attendent may be warned of a power failure. Also included in the circuit is an on/off switch 62 and a fuse 64.

Referring now to FIGS. 1 through 4 it will be seen that mattress supporting structure 18 is stabilized in its up and down movements in frame 10 by resilient means illustrated here as coil springs 52 and 54. Springs 52 interconnect the opposite corners of the mattress carrying frame member 28 with the opposite top edges of side walls 12 and 14. Springs 54 interconnect the corners of platform 20 with base 16 of frame structure 10. In addition to these coil springs there are provided hydraulic shock absorbers 56 connected to the corners of platform 20 and resting upon base 16 of frame 10.

OPERATION OF THE INVENTION

Now with regard as to how this preferred form of the invention best accomplishes its object in overcoming the mysterious disease of "infant death syndrome", first it will help to such understanding to know how the respiratory rate of infants or other bodies fluctuate. This is fully explained in the medical diagnostic book entitled "PHYSICAL DIAGNOSIS: A PHYSIOLOGIC APPROACH TO THE CLINICAL EXAMINATION" authored by fifteen contributing medical experts and edited by doctors Richard D. Judge and George D. Zuidema. Page 442 includes the following chart of various respiratory rates.

VARIATIONS IN RESPIRATORY RATES
(Quiet breathing)

| Age | Rate per minute |
|---|---|
| Premature | 40–90 |
| Newborn | 30–80 |
| 1 year | 20–40 |
| 2 years | 20–35 |
| 4 years | 20–35 |
| 10 years | 18–20 |
| Adult | 15–18 |

It has been determined by some medical experts that infant death syndrome occurs many times as the result of the comatose state of an infant when asleep, at which time the heart may cease to function because of a lack of stimulation.

Refering again to the various figures of the drawings, it will be seen that the speed of motor 42, when energized through the electrical circuit under control of the electronic speed control 50 will drive shaft 36 to rotate the cams 40 at the desired speed set by the knob 58 which will correspond to the predetermined respiratory rate of an infant reclining upon the mattress.

However, it should be understood that the knob of the electronic speed control 50 will be callibrated to supply speeds to comply with the various respiratory rates desired to fulfill the objects of the invention.

With that in mind, it can now be understood that given the respiratory rate of an infant to use the crib of the invention, the dial on knob 58 can easily be set to energise motor 42 to rotate the cams 40 at a corresponding speed, or one approcimatimg it.

Figure 4:
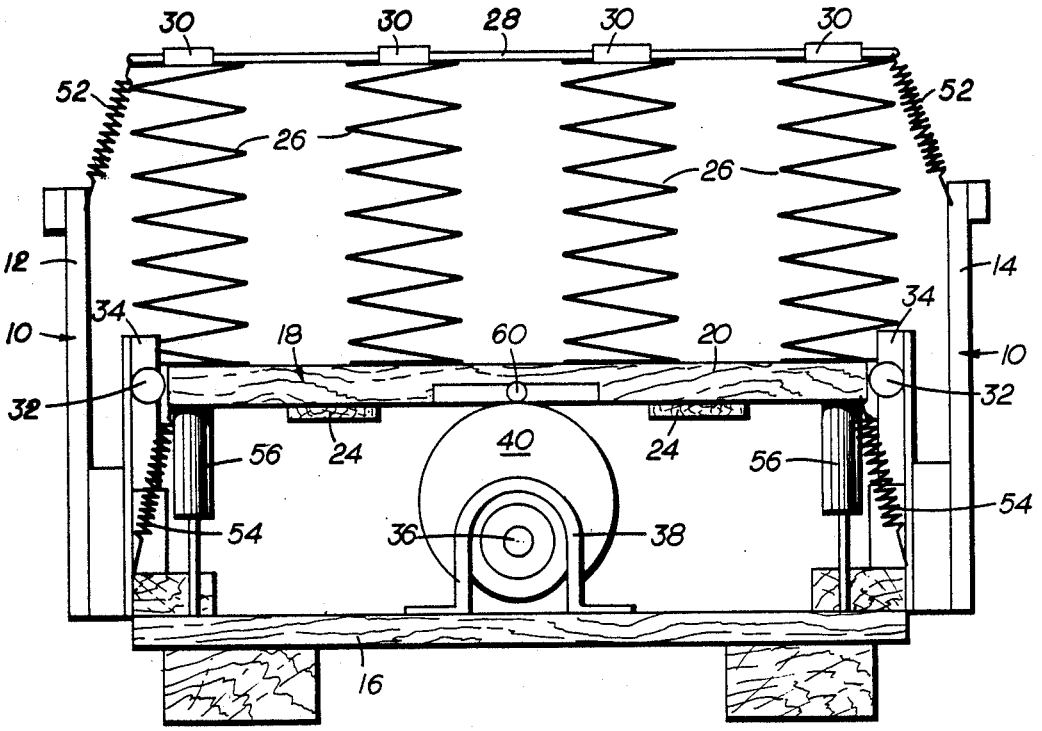
FIG. 4 is a view similar to FIG. 3 but showing an operative condition of the structure when a body (not shown) is present upon the mattress supporting member.

Now with reference to FIGS. 3 and 4, but first to FIG. 3, it will be seen that platform 20 is in its downward position with rollers 32 resting on the bottoms 35 of guideways 34 as urged by springs 52 and 54 with cams 40 out of contact with the underside of platform 20. This is the "at rest" condition of the assembled mattress supporting member 18 with no infant upon the mattress and therefor with bed springs 26 extended.

With an infant on the mattress, and the motor 42 energized, as described above, the cams are rotated at a speed to move their high points intermittently to strike against the underside of platform 20, as seen in FIG. 4, and jar it upward and the mattress against the infant reclining thereon substantially at the same rate as the infant's rate of respiration. As the cams rotate and their high points leave contact with the underside of platform 20 the weight of the infant on the mattress coupled with the springs 52 and 54 urge the platform downwardly to its "at rest" position on the bottoms of guideways 34 and out of contact with the platform. This movement is softened by the hydraulic shock absorbers 56.

To ease the jar or shock of the cams striking the underside of platform 20, a roller 60, preferably of a plastic material, is rotatibly mounted on the underside of the platform in the path of each of the cams high points. As the cams continue to rotate the rollers 60 rotate with them until the high points of the cams approach the lower portion of their rotation out of contact with the platform.

Thus it can clearly be understood that the crib structure of this preferred embodiment of the invention is capable of intermittently jarring an infant or other body reclining upon the mattress of the bed or crib and at a rate substantially equal to the predetermined respiratory rate of the infant or other body, thus to keep their hearts stimulated to continue beating regardless of whether asleep or not.

To enhance this action upon the infant the diaphragmatic control of its breath may be augmented by the use of pressure applied to its lower diaphragm area while lying upon its back. Such pressure may be applied by a weighted pressure belt secured around the subject's body.

What is claimed is:

1. A bio-engineered bed assembly for imparting intermittent vertical rectilinear up and down jarring movements to a mattress and a body supported thereon, comprising;

a frame member;

resilient means upon which said mattress is supported;

a platform mounting said resilient means upon said frame member for said intermittent vertical rectilinear up and down jarring movements; and electronically controlled means for imparting said intermittent vertical rectilinear up and down jarring movements to said platform and thereby to said resilient means and said mattress at a frequency substantially equal to the predetermined respiratory rate of a body reclining upon the mattress.

2. A bed structure for imparting intermittent jarring upward and downward vertical rectilinear movements to a mattress thereon and thereby to a person reclining upon the mattress, comprising:

a frame member;

a platform assembly mounted upon said frame member;

said platform assembly including a plurality of coil springs mounted on said platform and extending upwardly therefrom, and a mattress carrying bed frame secured to the upper ends of said coil springs;

guide means mounting said platform assembly upon said frame member for said intermittent jarring upward and downward vertical rectilinear movements; and electronically controlled means for imparting said intermittent jarring vertical rectiliner movements to said platform assembly and thereby to said mattress at a rate substantially equal to the predetermined respiratory rate of a person reclining upon the mattress.

3. A bed construction according to claim 2 wherein:

said means for imparting said intermittent jarring vertical rectilinear upward and downward movements to said platform assembly comprises:

eccentric cam means positioned beneath said platform assembly in position intermittently to engage the underside of said platform; and said electronically controlled means comprises:

a drive shaft mounted upon said frame member beneath said platform and on which said cam means is fixed;

a motor connected to said drive shaft;

means connecting said electronically controlled means to said motor and adapted for connecting both in series with a source of power thus to regulate the rate of rotation of said drive shaft and said cam means by said motor to effect intermittent contact of said cam means with the underside of said platform and thereby move the platform assembly in its intermittent jarring vertical rectilinear upward and downward movements at a rate in accordance with and substantially equal to the predetermined respiratory rate of a person reclining upon the mattress; and signal means for indicating the on/off condition of said source of power.

4. A bio-engineered crib assembly comprising:

a substantially U-shaped frame member having a base and spaced apart side walls extending upwardly from said base;

a plurality of upwardly extending guideways on the inner surfaces of said side walls;

a mattress carrying assembly positioned within said U-shaped frame member between said side walls, and comprising:

a platform;

a plurality of coil springs mounted upon said platform, and extending upwardly therefrom; and a mattress carrying member attached to the upper ends of said coil springs;

a plurality of rollers attached to opposite side edges of said platform and engaged within said guideways for permitting controlled upward and downward movements of said assembly in a horizontal plane within said U-shaped frame member;

first spring means connected between opposite sides of said mattress carrying member and the upper edges of the side walls of said U-shaped frame member;

second spring means connected to opposite sides of said platform and the base of said U-shaped frame member;

said first and second spring means cooperating with each other to urge said crib assembly downwardly into its at-rest position at the bottoms of said guideways;

a plurality of shock absorbers connected adjacent to the four corners of the underside of said platform and resting upon said base thus to absorb and smooth out the downward movement of said assembly;

a drive shaft extending centrally through said U-shaped frame member beneath said platform and journalled upon the base of said frame member;

eccentric cam means mounted upon said drive shaft beneath said platform and normally out of contact with the underside thereof but in position to contact and intermittently jar said mattress carrying assembly upwardly when rotated;

a motor connected to said drive shaft;

electronically controlled means connected to said motor and adapted for connection in series with a source of electrical power whereby when connected to said power source said motor is energized through said electronically controlled means whereby said cam means will be rotated intermittently against the underside of said platform thus to effect the said intermittent jolting vertical upward and downward movements thereof and consequently the same movement of the mattress and an infant reclining thereon.

* * * * *